US009154876B2

(12) United States Patent
Ko et al.

(10) Patent No.: US 9,154,876 B2
(45) Date of Patent: Oct. 6, 2015

(54) APPARATUS AND METHOD FOR GENERATING AN ACOUSTIC RADIATION PATTERN

(75) Inventors: Sang-Chul Ko, Seoul (KR); Young-Tae Kim, Seongnam-si (KR); Jung-Ho Kim, Yongin-si (KR); Jung-Woo Choi, Hwaseong-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 445 days.

(21) Appl. No.: 12/903,347

(22) Filed: Oct. 13, 2010

(65) Prior Publication Data

US 2011/0091042 A1 Apr. 21, 2011

(30) Foreign Application Priority Data

Oct. 20, 2009 (KR) ..... 10-2009-0099813

(51) Int. Cl.
*H04R 1/20* (2006.01)
*H04R 5/00* (2006.01)
*H04R 5/02* (2006.01)

(52) U.S. Cl.
CPC ..... *H04R 5/02* (2013.01)

(58) Field of Classification Search
CPC ..... H04R 2430/20; H04R 2201/401; H04R 2201/403; H04R 3/12; H04R 5/02
USPC ..... 381/300, 303, 306
See application file for complete search history.

(56) References Cited

U.S. PATENT DOCUMENTS

| | | | | |
|---|---|---|---|---|
| 5,092,336 | A | 3/1992 | Fink | |
| 5,438,624 | A | 8/1995 | Lewiner et al. | |
| 5,555,306 | A * | 9/1996 | Gerzon | 381/63 |
| 5,953,432 | A * | 9/1999 | Yanagawa et al. | 381/335 |
| 7,515,719 | B2 | 4/2009 | Hooley et al. | |
| 7,519,187 | B2 | 4/2009 | Konagai | |
| 7,529,376 | B2 | 5/2009 | Konagai | |

(Continued)

FOREIGN PATENT DOCUMENTS

| | | |
|---|---|---|
| JP | 6-205496 A | 7/1994 |
| JP | 07-288898 | 10/1995 |

(Continued)

OTHER PUBLICATIONS

Korean Office Action mailed on Aug. 4, 2015 in counterpart Korean Application No. 10-2009-0099813 (3 pages in English, 4 pages in Korean).

*Primary Examiner* — Curtis Kuntz
*Assistant Examiner* — Thomas Maung
(74) *Attorney, Agent, or Firm* — NSIP Law

(57) ABSTRACT

Disclosed are an apparatus and method for creating an acoustic radiation pattern, which may improve sound focusing performance to a target position. The acoustic radiation pattern creating apparatus may process an input signal which may be output through a speaker array in a room such that at least one vertical-directional reflected wave component of the input signal may overlap a direct sound of the input signal at the target position. Then, the acoustic radiation pattern creating apparatus may replicate the processed input signal by the number of output channels of the speaker array, and may process the replicated input signals such that the replicated input signals may form a predetermined radiation pattern in a horizontal direction in the room when the replicated input signals are output through the speaker array.

19 Claims, 10 Drawing Sheets

(56) References Cited

U.S. PATENT DOCUMENTS

| | | | | |
|---|---|---|---|---|
| 2004/0131338 | A1 | 7/2004 | Asada et al. | |
| 2005/0141735 | A1* | 6/2005 | Kim | 381/313 |
| 2006/0126878 | A1 | 6/2006 | Takumai et al. | |
| 2006/0153391 | A1 | 7/2006 | Hooley et al. | |
| 2006/0171547 | A1* | 8/2006 | Lokki et al. | 381/92 |
| 2008/0045864 | A1 | 2/2008 | Candy et al. | |
| 2008/0165979 | A1 | 7/2008 | Takumai | |

FOREIGN PATENT DOCUMENTS

| | | | |
|---|---|---|---|
| JP | 2003-61200 | A | 2/2003 |
| JP | 2004/172786 | | 6/2004 |
| JP | 2005-064746 | | 3/2005 |
| JP | 2005-101902 | | 4/2005 |
| JP | 2006-013711 | | 1/2006 |
| JP | 2006-109339 | | 4/2006 |
| KR | 10-2005-0095852 | | 10/2005 |

* cited by examiner

APPARATUS AND METHOD FOR GENERATING AN ACOUSTIC RADIATION PATTERN

CROSS-REFERENCE TO RELATED APPLICATION(S)

This application claims the benefit under 35 U.S.C. §119 (a) of Korean Patent Application No. 10-2009-0099813, filed on Oct. 20, 2009, the disclosure of which is incorporated by reference in its entirety for all purposes.

BACKGROUND

1. Field

The following description relates to an apparatus and method for generating an acoustic radiation pattern, and more particularly, to an apparatus and method for allowing a speaker array system comprising a plurality of speakers to output a desired acoustic radiation pattern.

2. Description of the Related Art

A speaker array, which is a combination of a plurality of speakers, is used to control the direction of sound to be reproduced by combining a plurality of speakers or to transfer sound to a predetermined location. While a large speaker is naturally more directional because of its large size, a source with equivalent directivity can be made by utilizing an array of traditional small speakers, all driven together in phase. Acoustically equal to a large speaker, this creates a larger source size compared to wavelength, and the resulting sound field may be narrowed compared to a single small speaker. Large speaker arrays have been used in hundreds of arena sound systems to mitigate noise that would ordinarily travel to adjoining neighborhoods, as well as limited applications in other areas in which some degree of directivity is helpful, such as museums or similar display applications that can tolerate large speaker dimensions.

The principle of sound transmission, generally called "directivity," is to make a plurality of sound source signals overlap each other using phase differences between the sound source signals in order to increase signal strength in a particular direction. As such, the sound source signals are transmitted in the particular direction. Thus, such directivity is realized by disposing a plurality of speakers in particular positions, and adjusting the source sound signals of the array, which are output through the speakers of the array.

A general array system calculates, in order to obtain a desired frequency beam pattern, filter values, i.e., gain and delay values suitable for the desired beam pattern. Thus, this method permits use of only one fixed beam pattern.

Recently, interest in a personal sound zone for transferring sound only to specific listeners without utilizing earphones or headsets, while not creating noise pollution to adjacent persons is increasing. A personal sound zone may be formed by driving a plurality of acoustic transducers to thereby acquire the directivity of sound. In order to utilize the directivity of sound, input signals which are to be output by a plurality of speakers need to be passed through functional filters such as time delay filters to concentrate sound in a particular direction or on a particular position, thereby creating sound beams.

SUMMARY

In one general aspect, there is provided an apparatus for creating an acoustic radiation pattern using a speaker array, including: a reflected wave overlapping filter configured to process an input signal which is output through a speaker array in a room and reaches a target position such that one or more vertical directional reflected wave components of the input signal overlap direct sound of the input signal at the target position, a replicator configured to replicate the processed input signal by the number of output channels of the speaker array, and a focusing filter configured to process the replicated input signals such that the replicated input signals form a predetermined radiation pattern in a horizontal direction in the room when the replicated input signals are output through the speaker array.

The apparatus may further include that the reflected wave overlapping filter is created by: measuring impulse responses from the speaker array to the target position in the room, extracting one or more vertical-directional reflected wave components from among the measured impulse responses, and performing time-reversal on the extracted vertical-directional reflected wave components.

The apparatus may further include that the reflected wave overlapping filter is created using gain and delay values of one or more vertical-directional reflected wave components which are extracted from impulse responses measured in a predetermined early reflection period among the impulse responses from the speaker array to the target position.

The apparatus may further include that the reflection wave overlapping filter includes: a distributor configured to: replicate the input signal by the number of the vertical-directional reflected wave components, and distribute the replicated input signals, an applying unit configured to apply the gain and delay values of the vertical-directional reflected wave components to the distributed input signals, and a summing unit configured to sum signals resulting from applying the gain and delay values to the distributed input signals.

The apparatus may further include that the reflection wave overlapping filter includes a Finite Impulse Response (FIR) filter designed using the gain and delay values of the vertical directional reflected wave components.

In another general aspect, there is provided an apparatus for creating an acoustic radiation pattern using a speaker array, including: a replicator configured to replicate an input signal by the number of output channels of a speaker array, and a filtering unit configured to process the replicated signals such that one or more vertical-directional reflected wave components of an input signal which are output through a speaker array in a room and reach a target position overlap direct sound of the input signal at the target position, and the input signal that is to pass through the speaker array forms a predetermined radiation pattern in a horizontal direction in the room when output through the speaker array.

The apparatus may further include that: the filtering unit includes a reflected wave overlapping filter created by: measuring impulse responses from the speaker array to the target position in the room, extracting one or more vertical-directional reflected wave components from among the measured impulse responses, and performing time-reversal on the extracted vertical-directional reflected wave components, and the reflected wave overlapping filter is configured to process the replicated signals such that one or more vertical-directional reflected wave components of the input signal reaching the target position overlap the direct sound of the input signal at the target position.

The apparatus may further include that the reflected wave overlapping filter is created using gain and delay values of the vertical-directional reflected wave components which are extracted from impulse responses measured in a predetermined early reflection period among the impulse responses from the speaker array to the target position.

In another general aspect, there is provided a method of creating an acoustic radiation pattern using a speaker array, including: primarily filtering an input signal which is output through a speaker array in a room and reaches a target position, using a reflected wave overlapping filter, such that one or more vertical-directional reflected wave components of the input signal overlap direct sound of the input signal at the target position, replicating the primarily filtered input signal by the number of output channels of the speaker array, and secondarily filtering the replicated input signals, using a focusing filter to form a predetermined radiation pattern in a horizontal direction in the room when the replicated input signals are output through the speaker array.

The method may further include creating the reflected wave overlapping filter by extracting one or more vertical-directional reflected wave components from impulse responses measured between the speaker array and the target position in the room and performing time-reversal on the extracted vertical-directional reflected wave components.

The method may further include that the creating of the reflected wave overlapping filter includes: extracting gain and delay values of the vertical-directional reflected wave components, from impulse responses measured in a predetermined early reflection period among the impulse responses measured between the speaker array and the target position, and creating the reflected wave overlapping filter using the gain and delay values of the vertical-directional reflected wave components.

The method may further include that the primarily filtering of the input signal includes: replicating the input signal by the number of the vertical-directional reflected wave components and distributing the replicated input signals, applying the gain and delay values of the vertical-directional reflected wave components to the distributed input signals, respectively, and summing signals resulting from applying the gain and the delay values to the distributed input signals.

The method may further include that the reflection wave overlapping filter includes a Finite Impulse Response (FIR) filter designed using the gain and delay values of the vertical directional reflected wave components.

The method may further include that a response at the target position may be calculated according to: $h_i(t) \approx \Sigma g_{ij}(t) * (q(-t) * f_i(t))$, wherein $h_i(t)$ is a first impulse response function, $g_{ij}(t)$ is a second impulse response function, $q(-t)$ is a time reversed third impulse response function, $f_i(t)$ is a focusing filter, i is a channel of a speaker array, and j is the target position.

In another general aspect, there is provided a method of creating an acoustic radiation pattern using a speaker array, including: replicating an input signal by the number of output channels of a speaker array, and processing the replicated signals such that: one or more vertical-directional reflected wave components of an input signal, which are output through a speaker array in a room and reach a target position, overlap direct sound of the input signal at the target position, and the input signal that is to pass through the speaker array forms a predetermined radiation pattern in a horizontal direction in the room when output through the speaker array.

The method may further include creating the reflected wave overlapping filter to primarily filter the replicated input signals by: extracting one or more vertical-directional reflection components from impulse responses measured between the speaker array and the target position in the room, and performing time-reversal on the extracted vertical-directional reflection components.

The method may further include that the creating of the reflected wave overlapping filter includes: extracting gain and delay values of the vertical-directional reflected wave components, from impulse responses measured in a predetermined early reflection period among the impulse responses measured between the speaker array and the target position, and creating the reflected wave overlapping filter using the gain and delay values of the vertical-directional reflected wave components.

The method may further include that a response at the target position may be calculated according to: $h_i(t) \approx \Sigma g_{ij}(t) * (q(-t) * f_i(t))$, wherein $h_i(t)$ is a first impulse response function, $g_{ij}(t)$ is a second impulse response function, $q(-t)$ is a time reversed third impulse response function, $f_i(t)$ is a focusing filter, i is a channel of a speaker array, and j is the target position.

Other objects, features and advantages may be apparent from the following description, the drawings, and the claims.

Figure 1A:
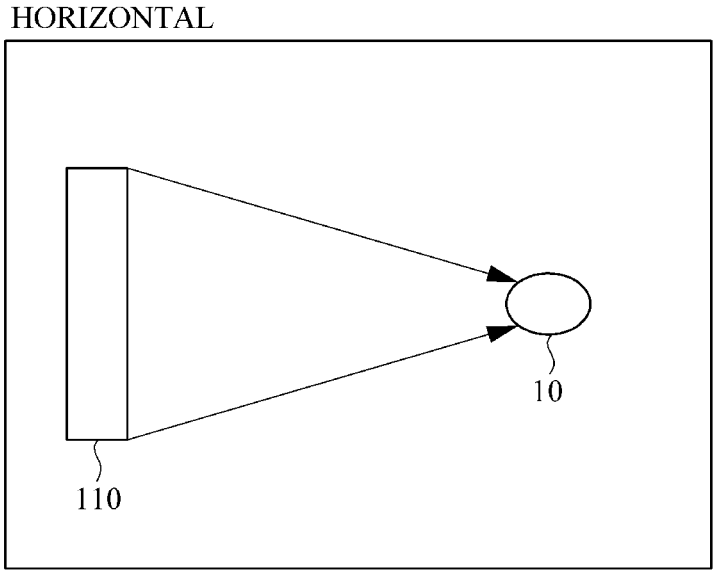
FIGS. 1A and 1B are diagrams for explaining the concept of a method of creating an acoustic radiation pattern.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

The following detailed description is provided to assist the reader in gaining a comprehensive understanding of the methods, apparatuses, and/or systems described herein. Accordingly, various changes, modifications, and equivalents of the systems, apparatuses and/or methods described herein will be suggested to those of ordinary skill in the art. The progression of processing steps and/or operations described is an example; however, the sequence of steps and/or operations is not limited to that set forth herein and may be changed as is known in the art, with the exception of steps and/or operations necessarily occurring in a certain order. Also, descriptions of well-known functions and constructions may be omitted for increased clarity and conciseness.

An acoustic radiation pattern may be obtained by patterning a sound field created by sound radiated from a signal outputting apparatus, such as a speaker, an antenna or the like.

The sound field is a conceptual expression for a region where sound pressure from a sound source has influence. Here, the term "sound pressure" represents the amount by which sound energy is affected, by using a physical quantity of pressure. The acoustic radiation pattern (or a beam pattern) may be created by receiving radiated sound signals according to distances from a speaker array using a measuring unit to measure output signals and visually illustrating the strengths of the received sound signals according to the respective measured distances on a graph.

Figure 1B:
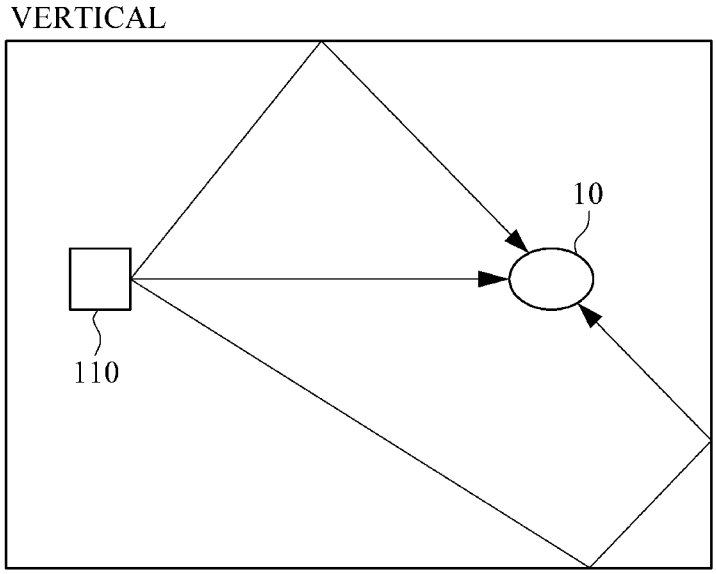

FIGS. 1A and 1B are diagrams for explaining the concept of a method of creating an acoustic radiation pattern.

A focusing filter, which may focus a sound source on a specific position in a horizontal direction, may be designed to adjust the gain or delay of each sound signal that is to be output through each speaker of a speaker array. The focusing filter may also be designed based on a method of designing a Least Square Error (LSE) filter. The LSE filter designing method has been developed to minimize errors between actual and desired patterns. The specific position on which sound focuses may be called a "target position" (generally, a listening area) or a "focusing position." Hereinafter, the specific position on which sound focuses will be called a "target position."

If a transfer function matrix between a speaker array and a measuring position is G and an input signal is processed by a filter w, an actual response pattern H may be calculated by Equation 1 below.

$$H=Gw \tag{1}$$

If a desired response pattern (that is, a target response pattern) is D, an error between the target response pattern D and the actual response pattern H can be expressed by Equation 2 below. In this case, the LSE filter designing method uses Equation 3 to calculate an optimal filter value, as follows.

$$E=|D-H|^2=|D-Gw|^2 \tag{2}$$

$$w=(G^TG)^{-1}G^TD \tag{3}$$

However, since an LSE filter is calculated under ideal conditions, the LSE filter may have performance deterioration, due to acoustic radiation, errors occurring in a control system, external noise, environmental variations, etc., when applied to actual systems. Specifically, when creating sound beams in a room using an acoustic radiation control system to which the LSE filter designing method is applied, echoes generated by reflection off the walls of the room, as well as direct waves radiated from a speaker array, be created.

The "direct wave" means sound output from the speaker array which is directly transferred to a target position. The echo may contain early reflections and later reverberations. The early reflections may be reflections when the sound pressure of direct waves is attenuated by about 6 dB. The early reflections may be primarily influenced by the geometrical characteristics (the sizes and shapes) of the space. The later reverberations are influenced by sound absorption or reflection characteristics of the space.

Meanwhile, a time reversal method may be used to focus a sound source on a specific position in a space where reflections occur. The time reversal method may calculate a time reversal filter using an impulse transfer function measured in a space where reflections occurs so that a signal reproduced by a speaker array through application of the time reversal filter may show maximum output efficiency at a specific target position.

If an impulse transfer function from a speaker array to a specific target position is q, a filter value may be calculated by the time reversal method, according to Equation 4 below.

$$w(\omega)=q^*(\omega) \tag{4}$$

Equation 4 may be rewritten in a time domain, as follows in Equation 5.

$$w(t)=q(-t) \tag{5}$$

That is, a function obtained by performing time-reversal on an impulse response function of each array source may be used as a filter value for a sound signal of each channel that is output from each speaker of a speaker array. A time-reversal filter may be relatively simply implemented since a required transfer function is defined by a position of a speaker array and a target position. However, the time-reversal method may fail to control sound pressure in other regions except a target region since the time-reversal filter may generate sidelobes in different directions from a target direction, thus reducing the sound pressure difference between the target and other regions compared to the acoustic radiation pattern control method using a focusing filter.

If a focusing filter is simply combined with a time-reversal filter, a mixed response of two responses may appear. In other words, an acoustic radiation pattern created by a focusing filter may be influenced by an acoustic radiation pattern created by the time-reversal method, which may increase the sidelobe, and consequently the pattern created by the time-reversal method may not show maximum energy at a target position due to the pattern value created by the acoustic radiation pattern control method using the focusing filter. Accordingly, there may be difficulties in simultaneously applying a focusing filter with a time-reversal filter through simple filter combination.

FIG. 1A is a top view showing a speaker array 110 and FIG. 1B is a side view of the speaker array 110.

An acoustic radiation pattern control method may direct, when focusing a sound source on a target position using the speaker array 110, an input signal in a horizontal direction using a focusing filter, as illustrated in FIG. 1A, and then may overlap reflected waves of the input signal in a vertical direction using a reflected wave overlapping filter, which may be designed based on the time-reversal method, as illustrated in FIG. 1B. That is, by directing an input signal to a target position 10 while causing reflected waves of the input signal to simultaneously reach the target position 10, it may be possible to increase sound pressure at the target position 10 relative to other positions.

When overlapping the reflected waves in a vertical direction, focusing performance may be improved by utilizing a time-reversal filter created using only vertical-directional reflective components among early reflections. Acoustic radiation pattern control may be carried out in a horizontal direction by a focusing filter since a vertical-directional reflected wave does not tend to spread over the peripheral areas.

In this case, since no conditions for reflection are considered with respect to any horizontal-directional sound sources that are directly transferred to the target position 10, it I possible that no transfer functions over the entire area in a room need to be measured and only vertical-directional reflection characteristics are considered in order to overlap vertical-directional reflected waves. The method of directing beams into a specific position in a horizontal direction and overlapping reflected waves in a vertical direction may utilize all advantages of the existing acoustic radiation pattern control method and time-reversal method. Also, the method may eliminate a need to measure all transfer functions over the entire area in a room.

Figure 2:
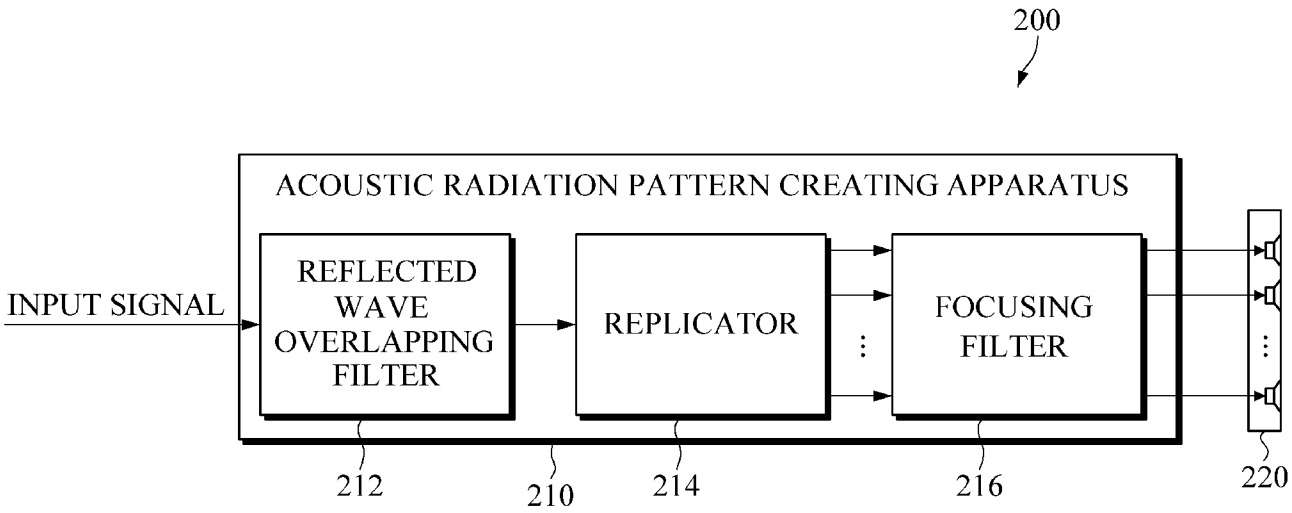
FIG. 2 is a diagram illustrating a configuration of an example speaker array system including an acoustic radiation pattern creating apparatus.

FIG. 2 is a diagram illustrating a configuration of an example speaker array system 200 including an acoustic radiation pattern creating apparatus 210.

Referring to FIG. 2, the speaker array system 200 may include the acoustic radiation pattern creating apparatus 210 and a speaker array 220. The speaker array system 200 may be a fixed electronic apparatus, such as a television or an audio system, to output sound signals using a speaker array, or may be a portable electronic apparatus, such as a PDA, a PMP, a mobile phone and the like.

As a non-exhaustive illustration only, the speaker array system 200 described herein may refer to mobile devices such as a cellular phone, a personal digital assistant (PDA), a digital camera, a portable game console, and an MP3 player, a portable/personal multimedia player (PMP), a handheld e-book, a portable tablet and/or laptop PC, a global positioning system (GPS) navigation, and devices such as a desktop PC, a high definition television (HDTV), an optical disc player, a setup box, and the like consistent with that disclosed herein.

The acoustic radiation pattern creating apparatus 210 may include a reflected wave overlapping filter 212, a replicator 214, and a focusing filter 216. A received input signal may be processed by the reflected wave overlapping filter 212 and then may be replicated by the number of output channels in the replicator 214. The replicated signals may be processed by the focusing filter 216 and then output through the speaker array 220.

For example, the reflected wave overlapping filter 212 may measure or calculate the reflection characteristics between the speaker array 220 and a target position, thus overlapping direct sound of the input signal at the target position with at least one reflected wave (or at least one reflected wave component) that is in a vertical direction to the input signal, based on the measured or calculated reflection characteristics.

Generally, reflected waves of an input signal may sequentially reach a target position along reflection paths after direct sound of the input signal reaches the target position, but the filter 212 for overlapping reflected waves based on the time-reversal method may cause at least one reflected sound of an input signal to reach a target position simultaneously when direct sound of the input signal reaches the target position. In other words, by causing at least one vertical-directional reflected wave component of an input signal to overlap with direct sound of the input signal at a target position, the vertical-directional reflected sound of the input signal may substantially reach the target position simultaneously with the direct sound of the input signal and then may overlap the direct sound. Accordingly sound pressure at the target position may be increased when the direct sound reaches the target position, compared to conventional methods.

In order to implement the reflected wave overlapping filter 212 for overlapping reflected waves at a target position, detection of at least one reflected wave component that is in a vertical direction to an input signal may be required. Also, in order to separate at least one vertical-directional reflected wave component from an input signal, an impulse response function from the target position to the speaker array 220 may be measured.

The impulse response function from the target position to the speaker array 220 may be identical to an input response function from the speaker array 220 to the target position in terms of the reciprocity theorem. Accordingly, impulse responses from the target location to the respective speakers of the speaker array 220 may be obtained by measuring an impulse response from the speaker array 220 to the target position instead of measuring an impulse response from the target position to the speaker array 220.

Accordingly, the reflected wave overlapping filter 212 may be created by measuring impulse responses from the speaker array 220 to the target position in a room, extracting at least one vertical-directional reflected wave component from among the measured impulse responses, and performing time-reversal on the vertical-directional reflected wave component. Alternatively, the reflected wave overlapping filter 212 may be created using the gain and delay values of at least one vertical-directional reflected wave component which is extracted from impulse responses measured in a predetermined early reflection period among impulse responses from the speaker array 220 to the target position.

The replicator 214 may replicate the input signal of which at least one vertical-directional reflected wave component will overlap the direct sound at the target position, by the number of output channels of the speaker array 220.

The focusing filter 216 may be composed simply of delay and gain values in order to focus a sound source on a specific position in a horizontal direction, or as described above, the focusing filter 216 may be designed by measuring a transfer function using the LSE filter designing method and the like in order to improve focusing performance. The focusing filter 216 may process the replicated signals to form a predetermined radiation pattern in a horizontal direction in the room when the replicated signals are output through the speaker array 220.

Figure 3:
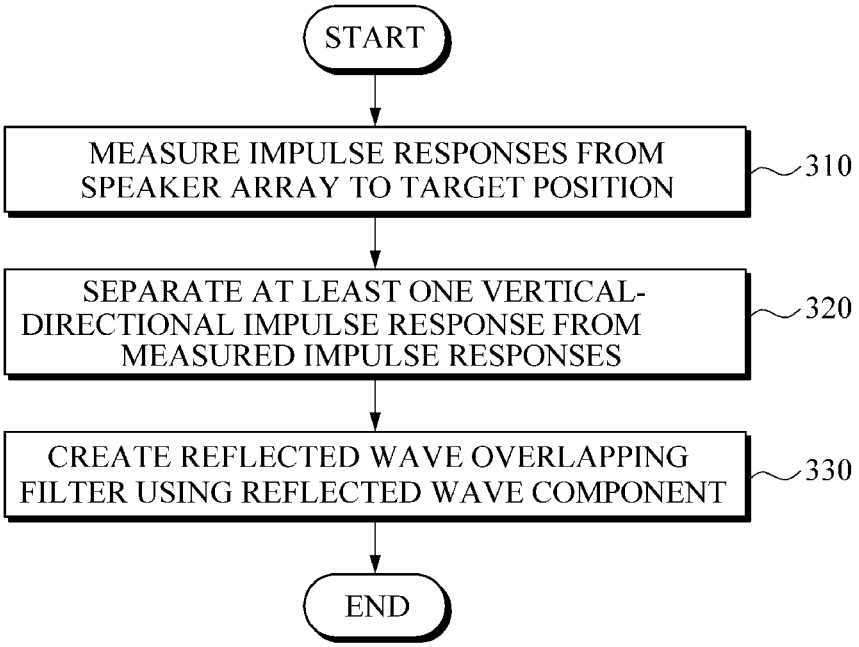
FIG. 3 is a flowchart of an example method of creating a reflected wave overlapping filter.

FIG. 3 is a flowchart of an example method of creating a reflective wave overlapping filter.

In operation 310, impulse responses from a speaker array to a target position may be measured in a room.

In operation 320, at least one vertical-directional impulse response may be extracted from among the measured impulse responses. The vertical-directional impulse response may include a reflected wave component that has reached the target position after being reflected by the front and rear walls, floor, ceiling, etc. of the room.

In operation 330, a reflected wave overlapping filter may be created using the reflected wave component according to the time-reversal method. The reflected wave overlapping filter may be created using the delay and gain values of the reflected wave component.

As described above, early reflections with high energy among reverberations in a room may depend on the geometrical shape of the room. A difference between a time at which direct sound reaches a target position and a time at which reflected sound reaches the target position may be calculated by subtracting a path distance of the direct sound from a path distance of the reflected sound and dividing the subtracted path distance by sound velocity, which may be expressed by Equation 6 below.

$$T_{ref1}-T_{direct}=(D_{ref1}-D_{direct})/C_{sound}, \quad (6)$$

where $T_{ref1}$ represents a time at which the reflected sound reaches the target position, $T_{direct}$ represents a time at which the direct sound reaches the target position, $D_{ref1}$ represents the path distance of the reflected sound from a speaker of a speaker array that has output a sound signal to the target position, $D_{direct}$ represents the path distance of the direct sound from the speaker to the target position, and $C_{sound}$ represents sonic velocity. Since a sound signal may be reflected anywhere, for example, at the ceiling, walls, etc. of the room, a plurality of vertical-directional reflection paths (e.g., $D_{ref1}$) may be measured and accordingly the time $T_{ref1}$ at which the reflected sound reaches the target position may be calculated for each reflection path. In this way, by utilizing impulse responses, a time at which each reflected wave component reaches a listening position may be calculated for each reflection path. Also, by utilizing a time at which each reflected wave component reaches the listening position, the delay and gain values of the reflected wave component may be extracted with respect to the corresponding direct sound.

Figure 4:
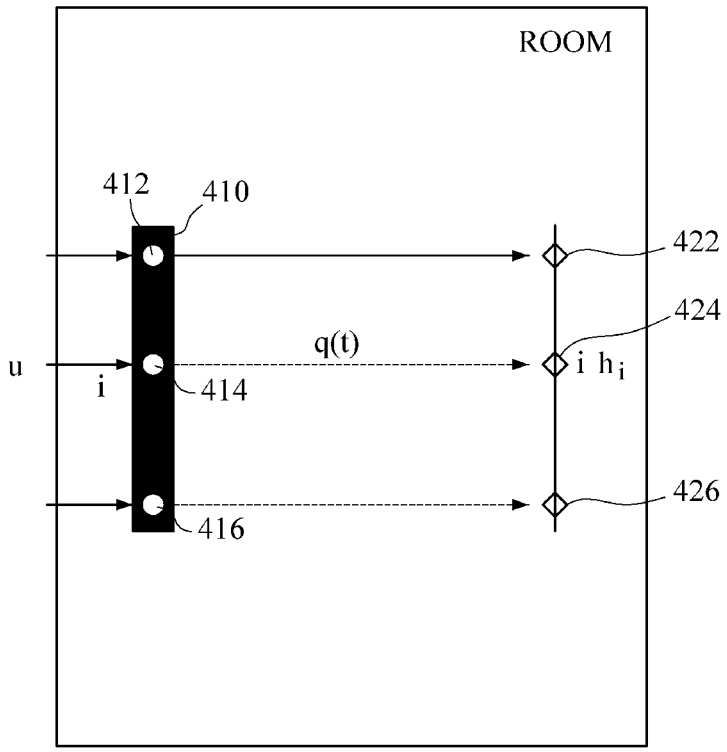
FIG. 4 is a diagram illustrating a configuration of an example apparatus of measuring impulse responses.

FIG. 4 is a diagram illustrating a configuration of an example apparatus of measuring impulse responses.

A reflected wave overlapping filter may be created simply by performing time-reversal on a measured impulse response. However, in one example, a long filter may be needed depending on the delay time of a reflected wave. Such an increase in length of a filter may require a large amount of calculation and a large memory capacity for filtering.

If speakers of a speaker array are arranged at positions which do not make great differences on reflection paths for room impulse responses. For example, if the speaker array 410 is placed to face the front or rear wall of a room or if the speaker array 410 is placed far away from the side walls of a room, there may be no great differences between vertical-directional reflected wave components for the outputs from the speaker array 410. In this case, since vertical-directional reflection characteristics from all speakers of the speaker array 410 are equalized, a reflected wave overlapping filter based on the time-reversal method to overlap vertical-directional reflected wave components may be applied to acoustic signals of all channels that are output through the speaker array 410.

In order to reduce the size of a reflected wave overlapping filter 212, only the gain and delay values of early vertical-directional reflected wave components of impulse responses may be extracted and filtered, which may reduce the amount of calculations and memory capacity required as compared to when using impulse responses themselves. Peak values of time-reversed components of impulse responses and delay values of the time-reversed components when they have the peak values may be stored in a memory. Then, a reflected wave overlapping filter 212 may be created using the peak values and delay values based on the time-reversal method.

As such, if the reflected wave overlapping filter 212 is applied to all sound signals that are output from the respective speakers of the speaker array 410, as illustrated in FIG. 4, when a speaker i of the speaker array 410 is set as a reference speaker in a space where reflections occur, an impulse response function from the speaker i to a microphone 424 facing the speaker i as a target position may be measured. If a speaker 412 of the speaker array 410 is set as a reference speaker, an impulse response function from the speaker 412 to a microphone 422 facing the speaker 412 may be measured. Likewise, if a speaker 416 of the speaker array 410 is set as a reference speaker, an impulse response function from the speaker 416 to a microphone 426 facing the speaker 416 may be measured.

As illustrated in FIG. 4, if an impulse response function from the reference speaker i 414 to the microphone 424 at a target position is measured as q(t) in a space where reflections occur, when a sound source is output from the speaker array 410 using a time-reversal filter expressed by Equation 7, an impulse response function $h_i(t)$ at the target position may be expressed by Equation 8 below.

$$w_i(t)=q_i(-t) \tag{7}$$

$$h_i(t)=g_i(t)*w_i(t)=g_i(t)*q_i(-t) \tag{8}$$

In this example, $g_i(t)$ represents the impulse response function from the reference speaker i 414 to the microphone 424 at the target position.

If vertical-directional reflected wave components from all speakers of the speaker array 410 are the same and a reflected wave overlapping filter based on the time-reversed method is applied to all the vertical-directional reflected wave components, an impulse response function at a target position may be expressed by Equation 9.

$$h_i(t)\approx g_i(t)*q(-t) \tag{9}$$

Figure 5A:
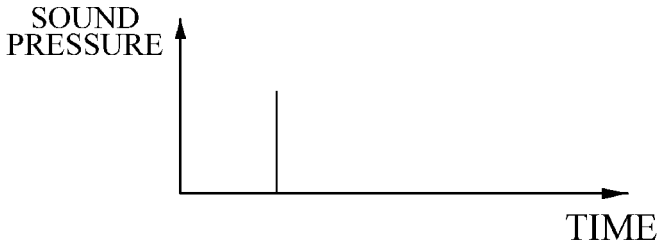
FIGS. 5A and 5B are diagrams showing an input signal of a speaker array and a signal measured in a microphone, respectively.
Figure 5B:
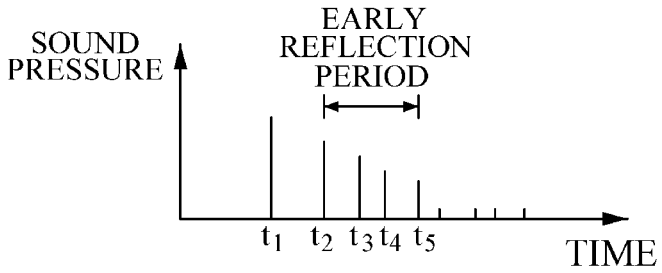

FIGS. 5A and 5B are diagrams showing an input signal of a speaker array and a signal measured in a microphone, respectively.

When an input signal of a speaker array is represented as illustrated in FIG. 5A, a signal as illustrated in FIG. 5B may be measured as a room impulse response q(t) from a microphone.

If a focusing filter f(t) is applied to a horizontal-directional focusing filter in order to perform horizontal-directional focusing on all vertical-directional signals to which a time-reversal filter has been applied, a response at a measuring location j is obtained as expressed by Equation 10.

$$h_i(t)\approx\Sigma g_{ij}(t)*(q(-t)*f_i(t)), \tag{10}$$

where i represents each channel of a speaker array and j represents a measuring location.

In FIG. 5B, if a peak response at a time $t_1$ is a response by direct sound and responses at times $t_2$, $t_3$, and $t_4$ are responses by early vertical-directional reflected wave sounds, a delay value of each reflected wave component, which is a delay from the response by the direct sound, may be calculated using the times $t_2$, $t_3$, and $t_4$, and also a gain value of each reflected wave component may be calculated using sound pressure at the times $t_2$, $t_3$, and $t_4$.

The above-described method may extract at least one reflected wave component using the distances of reflection paths, however, it may also be possible that the following method is used to extract reflected wave components.

A plurality of impulse responses may be obtained by receiving an impulse response to an input signal from a reference speaker selected from among speakers of a speaker array through a microphone facing the reference speaker while continuously varying the reference speaker to another one of the speakers. Then, at least one peak that is detected in common from among the impulse responses may be extracted as at least one reflected wave component. Successively, the gain and delay values of the reflected wave component may be extracted. The gain value of the reflected wave component may be decided by averaging a plurality of peak values of the corresponding reflected wave component or by selecting one of the peak values.

Figure 6:
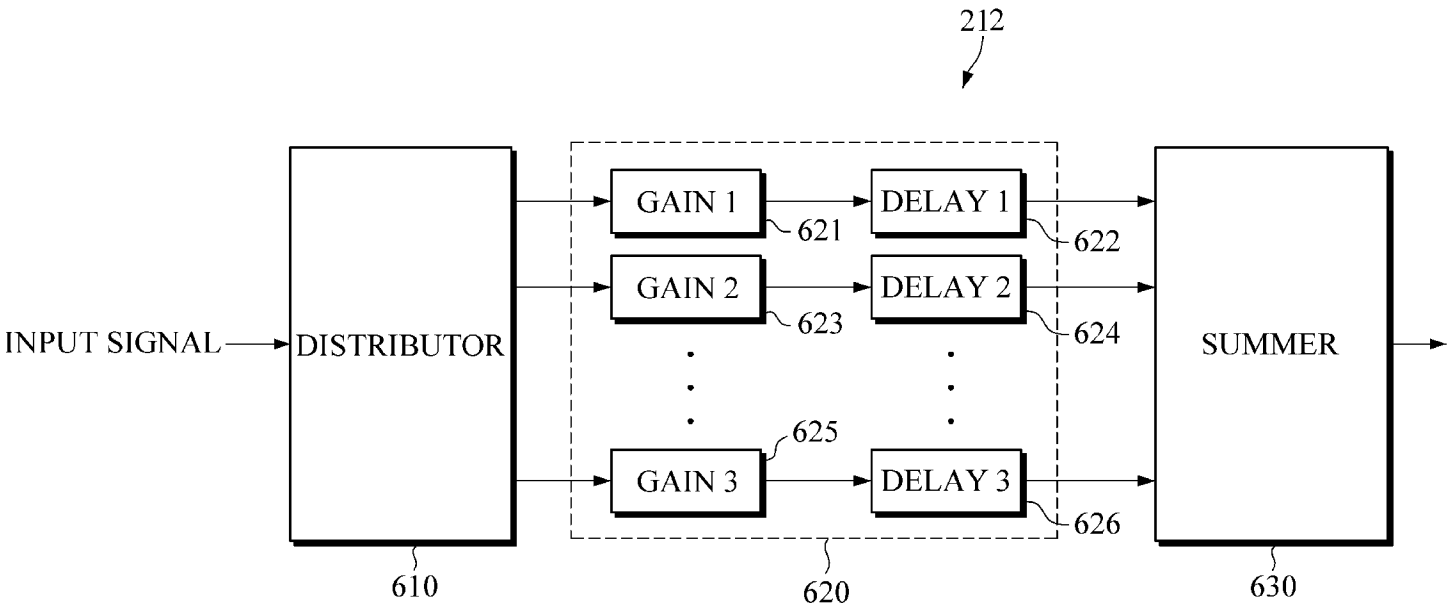
FIG. 6 is a diagram illustrating an example configuration of a reflected wave overlapping filter based on a time-reversal method.

FIG. 6 is a diagram illustrating an example configuration of a reflected wave overlapping filter 212 (see FIG. 2) based on a time-reversal method.

Referring to FIG. 6, the reflected wave overlapping filter may include a distributor 610, an applying unit 620, and a summer 630.

The distributor 610 may replicate an input signal by the number of extracted reflected wave components and distributes the replicated input signals. As described above with reference to FIG. 5B, when three early impulse reflected wave components are extracted, the distributor 610 may replicate the input signal to three signals and then transfer the three input signals to the applying unit 620.

The applying unit 620 may apply the gain and delay values of the extracted impulse reflected wave component to the input signals. As illustrated in FIG. 6, the applying unit 620 may include functional blocks (e.g., gain 1 (621), gain 2 (623), gain 3 (625), delay 1 (622), delay 2 (624) and delay 3 (626)) for applying the gain and delay values of a reflected wave component extracted from a room impulse response q(t).

Then, the summer 630 may sum the input signals to which the extracted gain and delay values have been applied. The resultant signal of the summing may be transferred to and replicated by the replicator 214, processed by the focusing filter 216, and then output through the speaker array 220 (see FIG. 2).

Figure 7:
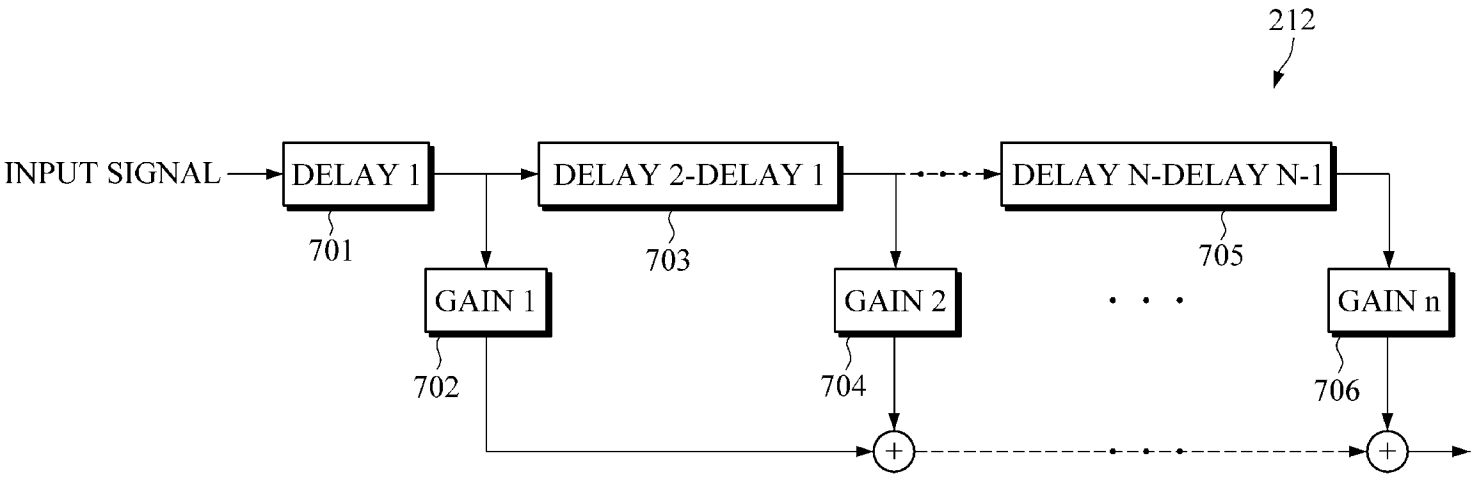
FIG. 7 is a diagram illustrating another example configuration of a reflected wave overlapping filter based on a time-reversal method.

FIG. 7 is a diagram illustrating another example configuration of a reflected wave overlapping filter 212 (see FIG. 2) based on a time-reversal method.

The reflected wave overlapping filter 212 illustrated in FIG. 2 may be a Finite Impulse Response (FIR) filter using the gain and delay values of reflected waves. As illustrated in FIG. 7, the gain and delay values may be transformed by the FIR filter. The reflected wave overlapping filter 212 receives an input signal, and overlaps reflected wave components entering a target position using the delay blocks 701, 703, and 705 and gain blocks 702, 704, and 706.

The gain blocks 702, 704, and 706 may perform the same functions as the functional blocks 621, 623, and 625 illustrated in FIG. 6, respectively. The delay 1 (701) may delay the input signal by a delay value of a first room reflected wave component. The delay 2-delay 1 (703) may delay the input signal delayed by the delay 1 (701) by a delay value between the first reflected wave component and the second reflected wave component, and the delay n-delay n-1 may delay a signal output from the previous delay block (not shown) by a delay value between a $n^{th}$ reflected wave component and a $(n-1)^{th}$ reflected wave component.

A signal processed through the reflected wave overlapping filter 700 may be transferred to and by the replicator 214 (see FIG. 2), processed by the focusing filter 216, and then output through the speaker array 220.

Figure 8:
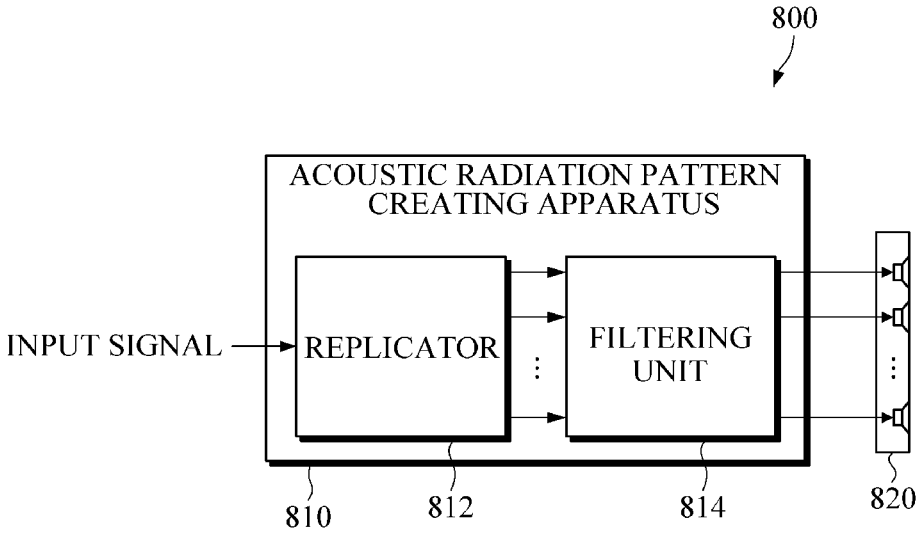
FIG. 8 is a diagram illustrating a configuration of another example speaker array system including an acoustic radiation pattern creating apparatus.

FIG. 8 is a diagram illustrating a configuration of another example speaker array system 800, including an acoustic radiation pattern creating apparatus 810.

The speaker array system 800 may include the acoustic radiation pattern creating apparatus 810 and a speaker array 820. The acoustic radiation pattern creating apparatus 810 may include a replicator 812 and a filtering unit 814.

The replicator 812 may replicate an input signal by the number of output channels of the speaker array 820.

The filtering unit 814 may be configured to perform all functions of a focusing filter and a reflected wave overlapping filter designed according to the time-reversal method.

The filtering unit 814 may be configured to cause at least one vertical-directional reflected wave component of an input signal to overlap direct sound of the input signal at a target position when a sound signal is output through the speaker array 820 in a room. This may be performed while filtering replicated signals of input signals that are to be output through the speaker array 820 in order for the replicated signals to form a predetermined radiation pattern in a horizontal direction in the room.

For this process, the filtering unit 814 may include a reflected wave overlapping filter (not shown) created by measuring impulse responses between the speaker array 820 and the target position in a room, extracting at least one vertical-directional component from among the measured impulse responses and performing time-reversal on the extracted component. The reflected wave overlapping filter may be created by calculating gain and delay values of at least one vertical-directional reflected wave component that is extracted from impulse responses received within a predetermined early reflection period.

Figure 9:
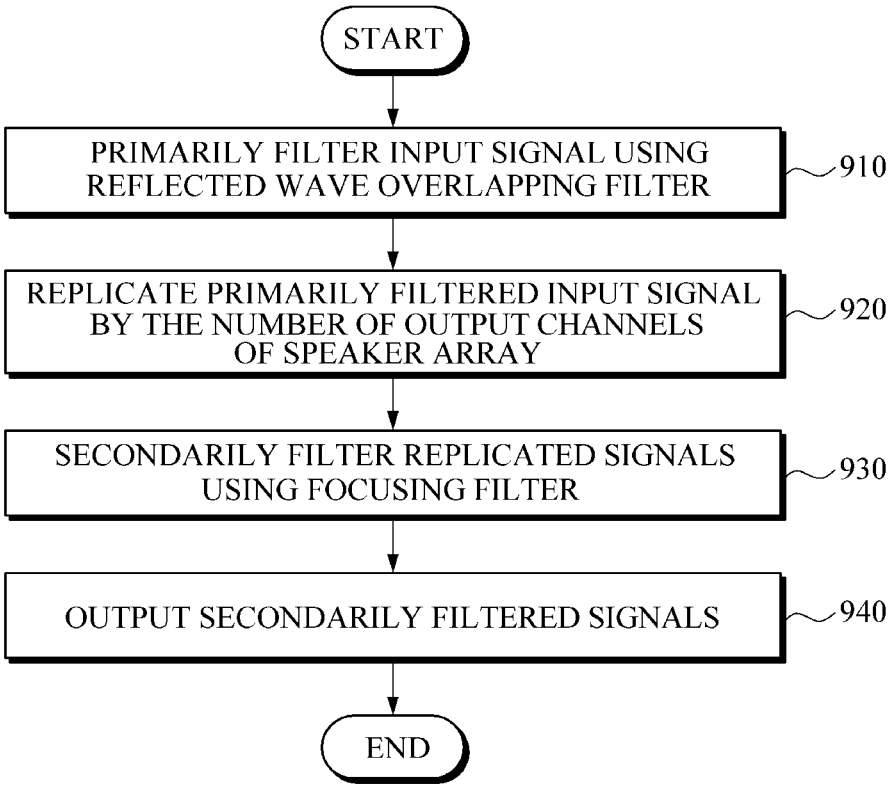
FIG. 9 is a flowchart of an example method of creating an acoustic radiation pattern.

FIG. 9 is a flowchart of an example method of creating an acoustic radiation pattern.

Referring to FIGS. 2 and 9, in operation 910, an input signal, which may be output through a speaker array in a room, may be filtered using a reflected wave overlapping filter 210 configured to cause at least one vertical-directional reflected wave component of the input signal to overlap direct sound of the input signal at a target position.

In operation 920, the filtered input signal may be replicated by the number of output channels of a speaker array.

In operation 930, the replicated signals may be secondarily filtered using a focusing filter to form a predetermined radiation pattern in a horizontal direction in a room when the replicated signals are output through the speaker array.

In an example of utilizing the acoustic radiation pattern creating apparatus 810 illustrated in FIG. 8, an acoustic radiation pattern may be created by the following method. An input signal may be replicated by the number of output channels of a speaker array (e.g., speaker array 820). When the input signal is output through a speaker array in a room, the input signal may be replicated (e.g., replicator 812) and processed by a filtering unit (e.g., filtering unit 814) so that at least one vertical-directional reflected wave component of an input signal reaching a target position overlaps direct sound of the input signal at the target location and an input signal that is to be output through the speaker array forms a predetermined radiation pattern in a horizontal direction in the room.

According to an embodiment, by simultaneously applying a reflected wave overlapping filter using the time-reversal method and a focusing filter based on controlling a horizontal-directional acoustic radiation pattern, a focusing performance of a speaker array system may be improved without increasing the complexity of the speaker array system.

The processes, functions, methods and/or software described above may be recorded, stored, or fixed in one or more computer-readable storage media that includes program instructions to be implemented by a computer to cause a processor to execute or perform the program instructions. The media may also include, alone or in combination with the program instructions, data files, data structures, and the like. The media and program instructions may be those specially designed and constructed, or they may be of the kind well-known and available to those having skill in the computer software arts. Examples of computer-readable media include magnetic media, such as hard disks, floppy disks, and magnetic tape; optical media such as CD-ROM disks and DVDs; magneto-optical media, such as optical disks; and hardware devices that are specially configured to store and perform program instructions, such as read-only memory (ROM), random access memory (RAM), flash memory, and the like. Examples of program instructions include machine code, such as produced by a compiler, and files containing higher level code that may be executed by the computer using an interpreter. The described hardware devices may be configured to act as one or more software modules in order to perform the operations and methods described above, or vice versa. In addition, a computer-readable storage medium may be distributed among computer systems connected through a network and computer-readable codes or program instructions may be stored and executed in a decentralized manner.

A number of example embodiments have been described above. Nevertheless, it will be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. An apparatus for creating an acoustic radiation pattern using a speaker array, the apparatus comprising:

a reflected wave overlapping filter configured to generate a processed signal by processing an input signal;

a replicator configured to generate replicated signals by replicating the processed signal by a number of output channels of the speaker array; and a focusing filter configured to generate acoustic signals by processing the replicated signals such that the acoustic signals form a predetermined radiation pattern in a horizontal direction in a room when output through the speaker array, wherein the reflected wave overlapping filter processes the input signal using gain and delay values of one or more vertically-directional reflected wave components extracted from impulse responses of a measurement signal measured at a target location, such that a vertically-directional reflected wave component and direct sound of the acoustic signals output by the speaker array overlap at the target position.

2. The apparatus of claim 1, wherein the reflected wave overlapping filter is created by performing time-reversal on the one or more extracted vertically-directional reflected wave components.

3. The apparatus of claim 2, wherein the reflected wave overlapping filter is created using the gain and delay values which are extracted from particular impulse responses measured in a predetermined early reflection period among the measured impulse responses of the measurement signal.

4. The apparatus of claim 3, wherein the reflection wave overlapping filter comprises:

a distributor configured to:

replicate the input signal by the number of the one or more vertically-directional reflected wave components extracted from the measured impulse responses to generate replicated input signals; and distribute the replicated input signals;

an applying unit configured to apply the gain and delay values of the one or more extracted vertically-directional reflected wave components to the distributed input signals; and a summing unit configured to sum signals resulting from applying the gain and delay values to the distributed input signals.

5. The apparatus of claim 3, wherein the reflection wave overlapping filter comprises a Finite Impulse Response (FIR) filter designed using the gain and delay values of the one or more extracted vertically-directional reflected wave components.

6. An apparatus for creating an acoustic radiation pattern using a speaker array, the apparatus comprising:

a replicator configured to generate replicated signals by replicating an input signal by a number of output channels of a speaker array; and a filtering unit configured to process the replicated signals and thereby generate acoustic signals that, when output by the speaker array, have a predetermined radiation pattern in a horizontal direction within a room and a vertically-directional reflected wave component and direct sound that overlap at a target position, wherein the filtering unit processes the replicated signals by applying gain and delay values of one or more vertically-directional reflected wave components extracted from impulse responses of a measurement signal measured at the target location.

7. The apparatus of claim 6, wherein the filtering unit comprises a reflected wave overlapping filter created by performing time-reversal on the one or more extracted vertically-directional reflected wave components.

8. The apparatus of claim 7, wherein the reflected wave overlapping filter is created using the gain and delay values which are extracted from particular impulse responses measured in a predetermined early reflection period among the measured impulse responses.

9. A method of creating an acoustic radiation pattern using a speaker array, the method comprising:

primarily filtering, sing a reflected wave overlapping filter, an input signal to generate a processed signal;

replicating the processed signal by a number of output channels of the speaker array to generate replicated signals; and secondarily filtering, using a focusing filter, the replicated signals so as to generate acoustic signals that, when output by a speaker array, form a predetermined radiation pattern in a horizontal direction in a room, wherein the reflected wave overlapping filter processes the input signal using gain and delay values of one or more vertically-directional reflected wave components extracted from impulse responses of a measurement signal measured at a target location, such that a vertically-directional reflected wave component and direct sound of the acoustic signals output by the speaker array overlap at the target position.

10. The method of claim 9, further comprising creating the reflected wave overlapping filter by performing time-reversal on the one or more extracted vertically-directional reflected wave components.

11. The method of claim 10, wherein the gain and delay values are extracted from particular impulse responses measured in a predetermined early reflection period among the measured impulse responses of the measurement signal.

12. The method of claim 11, wherein the primary filtering comprises:

replicating the input signal by the number of the one or more vertically-directional reflected wave components extracted from the measured impulse responses to generate replicated input signals;

distributing the replicated input signals;

applying the gain and delay values of the one or more extracted vertically-directional reflected wave components to the distributed input signals, respectively; and summing signals resulting from applying the gain and the delay values to the distributed input signals.

13. The method of claim 11, wherein the reflection wave overlapping filter comprises a Finite Impulse Response (FIR) filter designed using the gain and delay values of the one or more extracted vertically-directional reflected wave components.

14. The method of claim 9, wherein a response at the target position may be calculated according to:

$$h_i(t) \approx \Sigma g_{ij}(t) * (q(-t) * f_i(t)),$$

wherein $h_i(t)$ is a first impulse response function, $g_{ij}(t)$ is a second impulse response function, $q(-t)$ is a time reversed third impulse response function, $f_i(t)$ is a focusing filter, i is a channel of a speaker array, and j is the target position.

15. A method of creating an acoustic radiation pattern using a speaker array, the method comprising:

replicating an input signal by a number of output channels of a speaker array to generate replicated signals; and processing, with a filtering unit, the replicated signals to generate acoustic signals that, when output by a speaker array, have a predetermined radiation pattern in a horizontal direction within a room and a vertically-directional reflected wave component and direct sound that overlap at a target position, wherein the filtering unit processes the replicated signals by applying gain and delay values of one or more vertically-directional reflected wave components extracted from impulse responses of a measurement signal measured at the target location.

16. The method of claim 15, wherein the filtering unit comprises a reflected wave overlapping filter that performs time-reversal on the one or more extracted vertically-directional reflection components.

17. The method of claim 16, wherein the reflected wave overlapping filter obtains the gain and delay values from particular impulse responses measured in a predetermined early reflection period among the measured impulse responses.

18. The method of claim 15, wherein a response at the target position may be calculated according to:

$$h_i(t) \approx \Sigma g_{ij}(t) * (q(-t) * f_i(t)),$$

wherein $h_i(t)$ is a first impulse response function, $g_{ij}(t)$ is a second impulse response function, $q(-t)$ is a time reversed third impulse response function, $f_i(t)$ is a focusing filter, i is a channel of a speaker array, and j is the target position.

19. The apparatus of claim 1, wherein the target position is a position where a signal reaches, and is the same for the direct sound of the input signal and the vertically-directional reflected wave component of the acoustic signals.

* * * * *